United States Patent [19]

Kasahara et al.

[11] 4,277,162

[45] Jul. 7, 1981

[54] ELECTROPHOTOGRAPHIC APPARATUS COMPRISING DENSITY SENSOR MEANS

[75] Inventors: Nobuo Kasahara; Kouji Yamanobe, both of Tokyo, Japan

[73] Assignee: Ricoh Company, Ltd., Tokyo, Japan

[21] Appl. No.: 57,142

[22] Filed: Jul. 12, 1979

[30] Foreign Application Priority Data

Jul. 13, 1978 [JP] Japan ..... 53-85307
Jul. 19, 1978 [JP] Japan ..... 53-88775

[51] Int. Cl.[3] ..... G03G 15/00

[52] U.S. Cl. ..... 355/14 R; 355/3 R; 355/3 TR; 355/14 D

[58] Field of Search ..... 355/3 R, 3 TR, 14 R, 355/14 D, 14 TR

[56] References Cited

U.S. PATENT DOCUMENTS

| | | | |
|---|---|---|---|
| 3,700,323 | 10/1972 | Guyette et al. | 355/3 R |
| 3,788,739 | 1/1974 | Coriale | 355/3 R X |
| 3,822,093 | 7/1974 | Whited | 355/3 TR |
| 3,894,799 | 7/1975 | Prats | 355/3 R |
| 3,966,199 | 6/1976 | Silverberg | 355/3 TR X |
| 4,110,031 | 8/1978 | Ebi et al. | 355/3 TR X |

*Primary Examiner*—Fred L. Braun
*Attorney, Agent, or Firm*—David G. Alexander

[57] ABSTRACT

One or more marks (34), (36) are provided on a non-image area of a platen (23) which supports an original document (16). Electrostatic images of the document (16) and mark (34) are formed on a photoconductive drum (12) and developed to form toner images. The toner image of the original document (16) is transferred to a copy sheet (21) which is fed into contact with the drum (12) by a roller (119) or belt (19). The toner image of the mark (34) is transferred to the roller (119) or belt (19) and the optical density thereof sensed by a photosensor (39). The toner density, transfer charge and other parameters are controlled in accordance with the sensed optical density. An auxiliary sensor (91) may be provided to sense the optical density of the toner image of the mark (34) on the drum (12) prior to transfer for improved parameter control.

15 Claims, 12 Drawing Figures

ELECTROPHOTOGRAPHIC APPARATUS COMPRISING DENSITY SENSOR MEANS

BACKGROUND OF THE INVENTION

The present invention relates to an electrophotographic apparatus such as an electrostatic copying machine comprising sensors for sensing copy image density and controlling the operation of the copying machine in accordance with the sensed density.

In an electrostatic copying machine it is of course required that the copy images have optimum density and contrast as well as sharpness. To attain this goal it is necessary to control various operating parameters such as the toner density (ratio of toner to carrier in a two component developer), exposure intensity, electrostatic image potential, transfer charge potential and the like.

It is known in the art to sense the toner density by measuring the permeability, electrical resistance, light reflectance, fluidity, etc. of the developer. When the toner density drops below a predetermined value due to consumption of toner in the developing process, additional toner is added to increase the toner density and thereby prevent a reduction in copy density.

However, control of toner density alone is insufficient to ensure optimum copy density, or the density of the reproduced image on the finished copy sheet. In some cases, fatigue of the carrier particles in the developer and other factors can cause the image density to decrease even if the toner density is increased. The ambient temperature and humidity as well as fatigue of the carrier particles serve to cause fluctuations in the image density.

An improved method for control of copy image density is to measure the developing ability, rather than the toner density, of the developer. This is done by measuring the optical density of a toner image of a reference mark on a non-image area of a photoconductive drum or alternatively by measuring the amount of toner which adheres to an electrically charged electrode in a developing unit. This improved method, however, is still insufficient since the copy density can change even if the developing ability of the developer is maintained constant through optimal addition of toner. For example, a reduction in the transfer charge voltage will result in a reduction in copy image density even if the developing ability of the developer is maintained constant.

Other factors which affect the copy image density independently of the developing ability of the developer are fatigue of the photoconductive drum, variations of the initial and transfer charging voltages, exposure intensity and the like. The prior art method which measures the developing ability by sensing the amount of toner accumulated on an electrode provided in a flow path of developer in the developing unit cannot maintain the copy density constant since it is independent of the exposure and transfer processes.

SUMMARY OF THE INVENTION

An electrophotographic apparatus embodying the present invention has a platen for supporting an original document on an image area of the platen, a photoconductive member, imaging means for forming an electrostatic image of the original document on an image area of the photoconductive member, developing means for developing the electrostatic image to form a toner image, transfer means including a transfer member for supporting a copy sheet on an image area of the transfer member and moving the copy sheet into engagement with the photoconductive member for transferring the toner image to the copy sheet, and is characterized by comprising mark means of predetermined optical density provided on a non-image area of the platen, the imaging means forming an electrostatic image of the mark means on a non-image area of the photoconductive member, the developing means developing the electrostatic image of the mark means to form a toner image thereof, the transfer means transferring the toner image of the mark means onto a non-image area of the transfer member, and sensor means for sensing an optical density of the toner image of the mark means on the transfer member.

In accordance with the present invention, one or more marks are provided on a non-image area of a platen which supports an original document. Electrostatic images of the document and mark are formed on a photoconductive drum and developed to form toner images. The toner image of the original document is transferred to a copy sheet which is fed into contact with the drum by a roller or belt. The toner image of the mark is transferred to the roller or belt and the optical density thereof sensed by a photosensor. The toner density, transfer charge and other parameters and controlled in accordance with the sensed optical density. An auxiliary sensor may be provided to sense the optical density of the toner image of the mark on the drum prior to transfer for improved parameter control.

It is an object of the present invention to provide an improved accurate means for sensing the operating parameters of an electrostatic copying machine and maintaining the copy image density optimum in accordance with the measurement.

It is another object of the present invention to provide an electrophotographic apparatus comprising image density sensor means which is capable of optimal image density control.

It is another object of the present invention to provide an electrophotographic apparatus which is capable of producing high quality copies in a reliable manner.

It is another object of the present invention to provide a generally improved electrophotographic apparatus comprising density sensor means.

Other objects, together with the foregoing, are attained in the embodiments described in the following description and illustrated in the accompanying drawing.

DESCRIPTION OF THE PREFERRED EMBODIMENTS

While the electrophotographic apparatus of the present invention is susceptible of numerous physical embodiments, depending upon the environments and requirements of use, substantial numbers of the herein shown and described embodiments have been made, tested and used, and all have performed in an eminently satisfactory manner.

Figure 1:
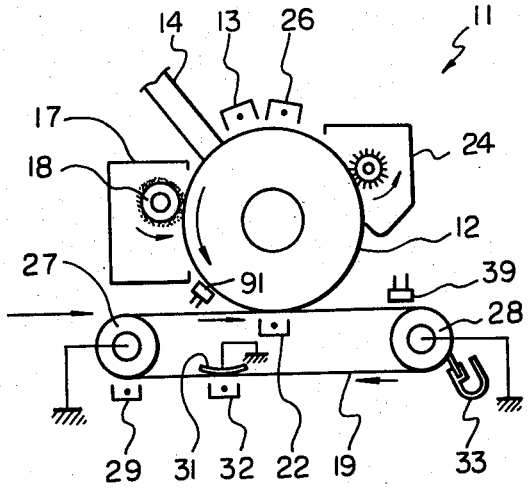
FIG. 1 is a schematic side elevation of an electrophotographic apparatus embodying the present invention.
Figure 2:
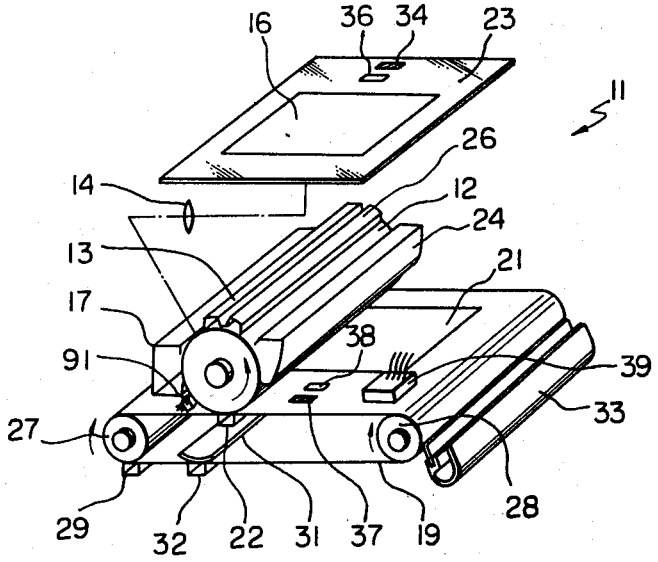
FIG. 2 is a perspective view of the present apparatus.

Referring now to FIGS. 1 and 2 of the drawing, an electrophotographic apparatus in the form of an electrostatic copying machine is generally designated by the reference numeral 11 and comprises a photoconductive drum 12 having a rotating photoconductive surface which is rotated counterclockwise at constant speed. A charging unit 13 applies a uniform electrostatic charge to the drum 12 in the dark. An optical imaging unit 14 radiates an optical image of an original document 16 onto the drum 12 to form an electrostatic image thereof through localized photoconduction. A developing unit 17 comprising a magnetic brush unit 18 applies a developing substance comprising carrier particles and toner particles to the drum 12 to develop the electrostatic image into a toner image. An endless belt 19 carries a copy sheet 21 into engagement with the drum 12 and a transfer charger 22 applies a charge to the belt 19 and copy sheet 21 which transfers the toner image to the copy sheet 21. A fixing unit (not shown) fixes the toner image to the copy sheet 21 to provide a finished copy.

The original document 16 is placed face down on an image area of a transparent platen 23. Further illustrated are a cleaning unit 24 for removing residual toner from the drum 12 and a discharge unit 26 for discharging the drum 12 prior to recharging by the unit 13.

The belt 19 has a dielectric outer surface and is trained around grounded rollers 27 and 28 for rotation in the clockwise direction at the same surface speed as the drum 12. Feeding of the copy sheet 21 is performed in such a manner that the leading edge of the copy sheet 21 aligns with the leading edge of the toner image on the drum 12 for perfectly registered toner image transfer. A precharger 29 charges the belt 19 so that the copy sheet 21 will adhere thereto by electrostatic force. A grounded shoe 31 in combination with a discharging unit 32 function to remove all charge from the belt 19 prior to precharging by the unit 29. Further illustrated is a scraper blade 33 for removing any toner transferred to the belt 19 from the drum 12.

In accordance with an important feature of the present invention, marks 34 and 36 having different predetermined optical densities are provided on a non-image area of the platen 23. Electrostatic images of the marks 34 and 36 are formed on a non-image area of the drum 12 and developed to form toner images of the marks 34 and 36. The toner images are transferred to a non-image area of the belt 19 (external of the image area which carries the copy sheet 21) and designated as 37 and 38 respectively. A photoelectric sensor 39 is provided above the non-image area of the belt 19 to sense the optical densities of the marks 37 and 38 separately.

Figure 3:
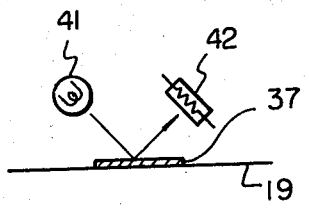
FIG. 3 is a schematic view of a first type of photosensor for use in the apparatus.
Figure 4:
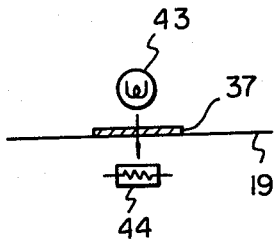
FIG. 4 is a schematic view of a second type of photosensor for use in the apparatus.

The sensor 39 is a double unit comprising two light sources such as incandescent bulbs or light emitting diodes and two photosensors comprising CDS photoelectric cells, photoresistors, photodiodes or phototransistors. An example of a unit for sensing the mark 37 is shown in FIG. 3 as comprising a bulb 41 and a photoresistor 42 for producing an output corresponding to reflected light from the mark 37. The higher the density of the mark 37, the smaller the amount of reflected light and the greater the resistance of the photoresistor 42. An alternative sensor arrangement is illustrated in FIG. 4 which is usable where the belt 19 is transparent. A light source is provided in the form of a bulb 43. A photoresistor 44 produces an output corresponding to the amount of light transmitted through the mark 37. The higher the density of the mark 37, the smaller the amount of transmitted light and the greater the resistance of the photoresistor 44.

The optical density of the mark 37 provides a good reference for adjustment of the various parameters of the copying machine 11 since it indicates the sum total of all variables in the copying process including the voltages of the chargers 13 and 22 which cannot be measured by a sensor which merely senses the developing ability of the developer. The optical density of the toner images of the marks 34 and 36 on the drum 12 fail to reflect variation in the voltage of the charger 22. Thus, the present invention takes into account all variables and maintains an optimal copy image density on the copy sheet 21 in accordance therewith.

Figure 5:
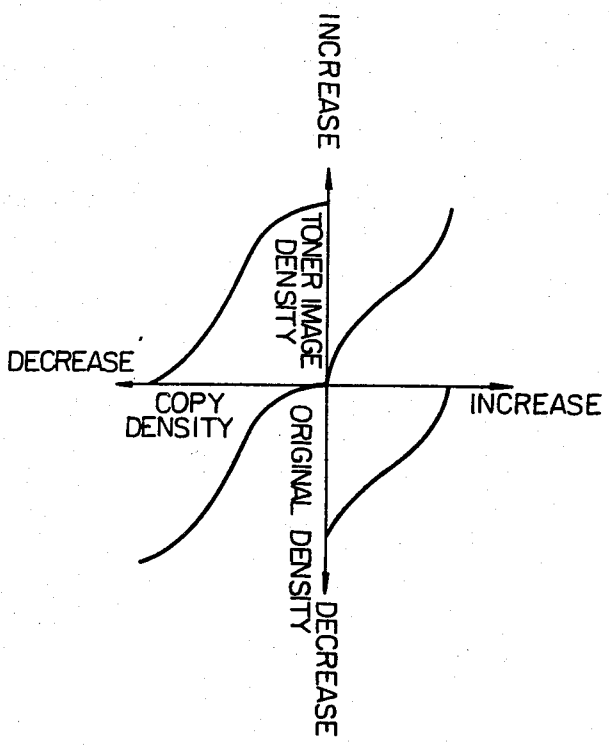
FIG. 5 is a graph illustrating the operation of the apparatus.

As illustrated in FIG. 5, an increase in the density of the image of the original document 16 produces an decrease in the electrostatic potential on the drum 12. Such an increase in electrostatic potential causes an increase in the toner image density. An increase in the toner image density causes an increase in the copy image density. As the sum total of these processes an increase in the density of the original document causes an increase in the density of the finished copy.

However, the copy density will be insufficient even if the density of the original document image is high if the voltage of the charger 13 is too low, the drum 12 has incurred electrical fatigue, etc. The toner image density on the drum 12 will be insufficient even if the original document density is high if the toner density is low, the developing ability of the developer is low, the developing bias voltage is excessive, etc. The copy density will be insufficient even if the toner image density on the drum 12 is sufficient if the voltage of the transfer charger 22 is too low. As yet another factor, the copy image density will be too high if the intensity of the light image radiated onto the drum 12 by the imaging unit 14 is too low due to deterioration of the light source, etc. The present invention overcomes the drawbacks of the prior art because it takes all of these factors into account in adjusting the copy image density to the optimal value.

Figure 6:
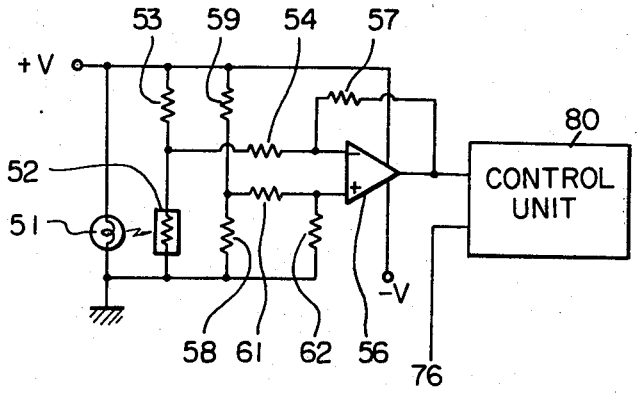
FIG. 6 is an electrical schematic diagram of a first comparator means of the apparatus.

As shown in FIG. 6, the sensor 39 comprises a light source in the form of a bulb 51 and a photoresistor 52 for sensing the optical density of the mark 37. The corresponding mark 34 on the platen 23 has a high density such as 1.8. The bulb 51 is connected between a positive D.C. source +V and ground. The photoresistor 52 has one end connected to ground and the other end connected through a resistor 53 to the source +V. The junction of the photoresistor 52 and resistor 53 is connected through a resistor 54 to an inverting input of an operational amplifier 56. A feedback resistor 57 connected between the output and inverting input of the operational amplifier 56 causes the amplifier 56 to operate as a differential amplifier. The operational amplifier 56 is powered by the source +V and a negative D.C. source −V. A relatively high reference voltage corresponding to a relatively high reference optical density is applied to the non-inverting input of the operational amplifier 56 by means of a voltage divider consisting of resistors 58 and 59 connected between the source +V and ground. The junction of the resistors 58 and 59 is connected through a resistor 61 to the non-inverting input of the operational amplifier 56. A resistor 62 is connected between the non-inverting input of the operational amplifier 56 and ground.

Figure 8:
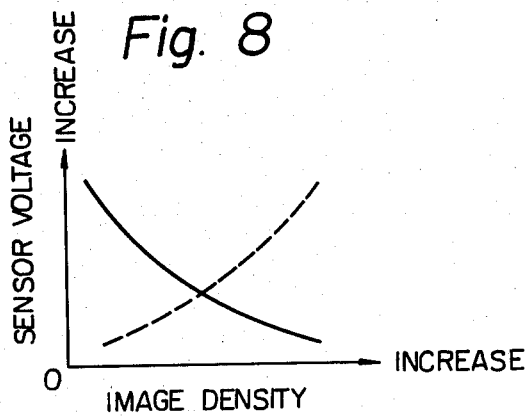
FIG. 8 is a graph illustrating the operation of the comparator means of FIGS. 6 and 7.

The operation of the circuit of FIG. 6 is illustrated by a solid line curve in FIG. 8. When the density of the mark 37 is below the reference value corresponding to the voltage at the non-inverting input of the operational amplifier 56, the voltage across the photoresistor 52 is low and the output voltage of the operational amplifier 56 is high. As the mark density increases, the voltage across the photoresistor 52 increases and the output voltage of the operational amplifier 56 decreases. When the output voltage of the operational amplifier 56 is high, it indicates that the copy image density is insufficient.

Figure 7:
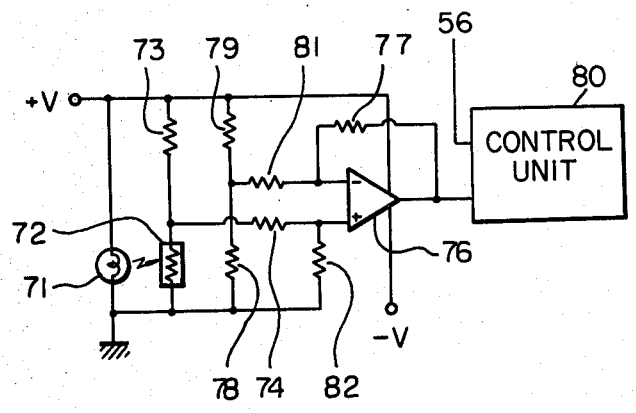
FIG. 7 is an electrical schematic diagram of a second comparator means of the apparatus.

As shown in FIG. 7, the sensor 39 further comprises a light source in the form of a bulb 71 and a photoresistor 72 for sensing the optical density of the mark 38. The corresponding mark 36 on the platen 23 has a low density such as 0.05. The bulb 71 is connected between the positive D.C. source +V and ground. The photoresistor 72 has one end connected to ground and the other end connected through a resistor 73 to the source +V. The junction of the photoresistor 72 and resistor 73 is connected through a resistor 74 to a non-inverting input of an operational amplifier 76. A feedback resistor 77 connected between the output and inverting input of the operational amplifier 76 causes the amplifier 76 to operate as a differential amplifier. The operational amplifier 76 is powered by the source +V and the negative D.C. source −V. A relatively low reference voltage corresponding to a relatively low reference optical density is applied to the inverting input of the operational amplifier 76 by means of a voltage divider consisting of resistors 78 and 79 connected between the source +V and ground. The junction of the resistors 78 and 79 is connected through a resistor 81 to the inverting input of the operational amplifier 76. A resistor 82 is connected between the non-inverting input of the operational amplifier 76 and ground.

The operation of the circuit of FIG. 7 is illustrated by a broken line curve in FIG. 8. When the density of the mark 38 is below the reference value corresponding to the voltage at the inverting input of the operational amplifier 76, the voltage across the photoresistor 72 is low and the output voltage of the operational amplifier 76 is low. As the mark density increases, the voltage across the photoresistor 72 increases and the output voltage of the operational amplifier 76 increases. When the output voltage of the operational amplifier 76 is high, it indicates that the background image density is excessive.

A control means or unit 80 receives the outputs of the operational amplifiers 56 and 76 and controls the operating parameters of the copying machine 11 in accordance therewith. No adjustment is required when the outputs of both operational amplifiers 56 and 76 are low. If the output of the operational amplifier 56 is high and the output of the operational amplifier 76 is low, it indicates that although the background area (white background) density is not excessive, the dark area density is insufficient. The problem is likely caused by insufficient toner density and the control means will cause an additional amount of toner to be added to the developer. Also, the voltage applied to the charger 22 may be increased.

If the output of the operational amplifier 56 is low and the output of the operational amplifier 76 is high, it indicates that although the dark area density is sufficient, the background area density is too high. This is typically caused by insufficient developing bias voltage, and the control means 80 will cause the developing bias voltage to be increased. Other causes are insufficient light image intensity and fatigue of the drum 12, which may be compensated for by the control means 80.

When the outputs of both operational amplifiers 56 and 76 are high, it indicates that the background area density is too high (the background areas appear grey) and the dark density is too low (the dark areas appear washed out). In other words, the contrast is too low. In such a case, the control means 80 may appropriately vary the exposure intensity, bias voltage, voltages applied to the chargers 13 and 22 and the like.

Figure 9:
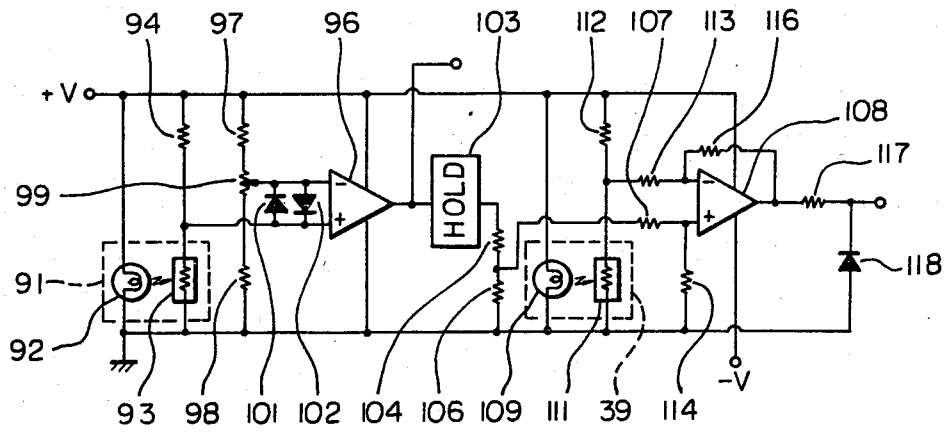
FIG. 9 is an electrical schematic diagram of a third comparator means of the apparatus.

In order to yet more effectively adjust the operation of the apparatus 11, an auxiliary sensor 91 may be provided to measure the density of the toner image of one or both of the marks 34 and 36 on the drum 12 after development and before toner image transfer. A circuit for producing control signals in accordance with the outputs of both sensors 39 and 91 is illustrated in FIG. 9.

The sensor 91 is shown as comprising a bulb 92 and photoresistor 93. The bulb 91 is connected between a positive D.C. source +V and ground. The photoresistor 93 is connected in series with a resistor 94 between the source +V and ground. The junction of the photoresistor 93 and resistor 94 is connected to a non-inverting input of an operational amplifier 96.

A reference voltage corresponding to a reference optical density is applied to the inverting input of the operational amplifier 96 from a voltage divider consisting of fixed resistors 97 and 98 connected in series with a potentiometer 99. The slider of the potentiometer 99 is connected to the inverting input of the operational amplifier 96 and allows adjustment of the reference voltage. A pair of diodes 101 and 102 are connected back to back across the inputs of the operational amplifier 96 and provide overvoltage protection. The operational amplifier 96 is powered by the source +V and functions as a voltage comparator.

The output of the operational amplifier 96 is connected through a hold circuit 103 and resistors 104 and 106 to ground. The junction of the resistors 104 and 106 is connected through a resistor 107 to the non-inverting input of an operational amplifier 108 which is powered by the source +V and a negative D.C. source −V. The sensor 39 is here shown as comprising a bulb 109 connected between the source +V and ground and a photoresistor 111 which is connected in series with a resistor 112 between the source +V and ground. The junction of the photoresistor 111 and resistor 112 is connected through a resistor 113 to the inverting input of the operational amplifier 108. A resistor 114 is connected between the non-inverting input of the operational amplifier 108 and ground. A feedback resistor 116 connected between the output and inverting input of the operational amplifier 108 and causes the operational amplifier 108 to function as a differential amplifier. The output of the operational amplifier 108 is connected through a resistor 117 to the cathode of a diode 118. The anode of the diode 118 is connected to ground. The resistor 117 and diode 118 in combination constitute a clamp which prevents the output of the operational amplifier 108 from going negative.

Assuming that the mark 34 is to be sensed, the circuit of FIG. 9 operates as follows. The sensor 91 senses the optical density of the toner image of the mark on the drum 12. If the density is higher than the reference value, the operational amplifier 96 produces a high output and vice-versa. The hold circuit 103 holds the output of the operational amplifier 96 until the toner image 37 of the mark 34 is sensed by the sensor 39.

If the output of the operational amplifier 96 is high, it indicates that the toner image density on the drum 12 is sufficient. If, however, the output of the operational amplifier 96 is low, it indicates that the toner image density on the drum 12 is insufficient. In the latter case, a corrective operation such as adding toner to the developer is effected by a control unit.

If the output of the operational amplifier 96 is high, this voltage is applied to the non-inverting input of the operational amplifier 108 by means of the resistors 104 and 106 which constitute a voltage divider. If the output of the operational amplifier 96 is low, a zero voltage is applied to the non-inverting input of the operational amplifier 108 under which conditions the operational amplifier 108 will produce a low output regardless of the output of the sensor 39.

Assuming that the output of the operational amplifier 96 is high and the density sensed by the sensor 39 is low, the operational amplifier 108 will produce a high output. This indicates that although the density of the toner image on the drum 12 is sufficient, the density of the mark 37 on the belt 19 is insufficient. In this case, the control means will cause the voltage applied to the charger 22 to be increased.

Figure 10:
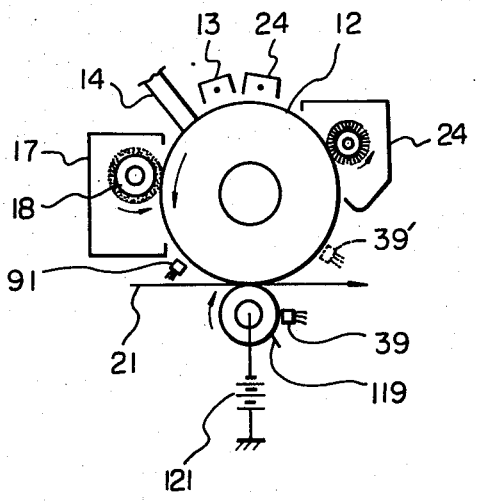
FIG. 10 is a schematic side elevation of another embodiment of an electrophotographic apparatus of the present invention.

FIG. 10 illustrates another embodiment of the present invention in which like elements are designated by the same reference numerals. Here, the transfer belt 19 is replaced by an electrically conductive roller 119 which is biased by a D.C. voltage source 121. In this case, the sensor 39 is disposed in such a position as to sense the density of a toner image of a mark formed on a non-image area of the roller 119. FIG. 10 also illustrates an alternative embodiment in which the sensor 39 is replaced by a sensor 39' illustrated in broken line. The sensor 39' is disposed downstream of the roller 119 in the direction of movement of the drum 12 and senses the residual amount of toner which remains after the toner image of the mark is transferred to the roller 119. Since complete transfer of toner from the drum 12 to the roller 119 is impossible, the density of the toner image of the mark on the roller 119 may be obtained by subtracting the density of the toner image sensed by the sensor 39' from the density sensed by the sensor 91. It is of course possible to provide the sensor 39' in the embodiment of FIG. 1.

Figure 11:
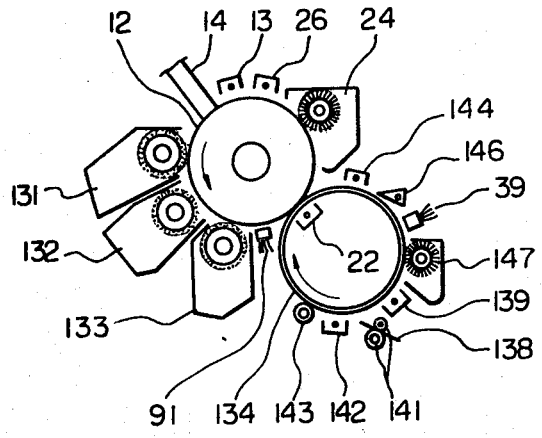
FIG. 11 is a schematic side elevation of a three color electrophotographic apparatus embodying the present invention.
Figure 12:
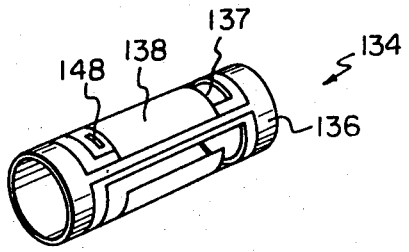
FIG. 12 is a perspective view of a transfer drum and copy sheet of the apparatus of FIG. 11.

FIGS. 11 and 12 show how the present invention may be applied to a full (three) color copying machine. Here, the developing unit 17 is replaced by a yellow developing unit 131, a magenta developing unit 132 and a cyan developing unit 133. The belt 19 is replaced by a transfer drum 134. As shown in FIG. 12, the drum 134 comprises a skeleton cylinder 136, a dielectric sheet 137 wound on the cylinder 136 and a clamp (not shown) for clamping a copy sheet 138 on the sheet 137. Further illustrated are a precharger 139 which charges the drum 134 to adhere the copy sheet 138 thereto, feed rollers 141 for feeding the copy sheet 138 to the drum 134 at the proper timing, a charger 142 for precharging the image receiving surface of the copy sheet 138, a guide roller 143, a discharger 144, a retractable separation pawl 146 and a cleaning unit 147 for cleaning transferred toner from the drum 136. The sensor 39 is disposed so as to sense the optical density of a toner image of a mark 148 on a non-image area of the sheet 137.

First, a light image of an original color document is focussed onto the drum 12 through a blue filter to form a first electrostatic image which is developed by the yellow developing unit 131 to form a yellow toner image. The copy sheet 138 is fed to and clamped on the drum 136 and the yellow toner image transferred thereto. The density of the mark 148 (which will be yellow) is sensed by the sensor 39 and operated on by either of the circuits of FIGS. 6, 7 and 9.

Then, the drum 12 is cleaned and the light image of the document focussed thereon through a green filter to form a second electrostatic image which is developed by the magenta developing unit 132. The magenta toner image is transferred to the copy sheet 138 in register with the yellow toner image. During this time, the mark 148, which will be magenta, is sensed by the sensor 39.

Then, the light image of the document is focussed on the drum 12 through a red filter and the resulting electrostatic image developed using the cyan developing unit 133 to produce a cyan toner image. The cyan toner image is transferred to the copy sheet 138 in register with the yellow and magenta toner images to provide a full color copy. The cyan mark 148 is sensed by the sensor 39.

After the three toner images have been transferred to the copy sheet 138, the sheet 138 is removed from the drum 134 by the pawl 146 and the toner images are fixed to the copy sheet 138. The sensor 91 is also illustrated in FIG. 11 for use with the sensor 39 and circuit of FIG. 9. Further details of a basic color electrostatic copying machine may be found in Japanese patent application no. 84,525 which is incorporated herein by reference.

The arrangement of FIG. 11 functions to sense the mark 148 which corresponds sequentially to each of the toner images and adjust the toner density of the developers in the units 131, 132 and 133 in sequence. During the first operation, the density of the yellow toner image is sensed and adjusted if necessary. During the second and third operations the density of the magenta and cyan toner images are sensed and adjusted respectively. This arrangement ensures true color fidelity since excessive or insufficient density of any of the toner images will result in an erroneous hue.

In summary, it will be seen that the present invention overcomes the drawbacks of the prior art and ensures that the density and contrast of copies made by an electrophotographic copying machine will be optimal. Various modifications will become possible for those skilled in the art after receiving the teachings of the present disclosure without departing from the scope thereof. For example, the present invention may be applied to a semimoist development type copying machine.

What is claimed is:

1. An electrophotographic apparatus having a platen for supporting an original document on an image area of the platen, a photoconductive member, imaging means for forming an electrostatic image of the original document on an image area of the photoconductive member, developing means for developing the electrostatic image to form a toner image, transfer means including a transfer member for supporting a copy sheet on an image area of the transfer member and moving the copy sheet into engagement with the photoconductive member for transferring the toner image to the copy sheet, characterized by comprising:

mark means of predetermined optical density provided on a non-image area of the platen, the imaging means forming an electrostatic image of the mark means on a non-image area of the photoconductive member, the developing means developing the electrostatic image of the mark means to form a toner image thereof, the transfer means transferring the toner image of the mark means onto a non-image area of the transfer member;

sensor means for sensing an optical density of the toner image of the mark means on the transfer member; and auxiliary sensor means for sensing an optical density of the toner image of the mark means on the photoconductive member before transfer to the transfer member and computing means for producing an output corresponding to a predetermined function of a difference between outputs of the sensor means and the auxiliary sensor means.

2. An apparatus as in claim 1, in which the sensor means comprises a photosensor.

3. An apparatus as in claim 1, further comprising computing means for producing an output signal when the optical density sensed by the sensor means is above a predetermined value.

4. An apparatus as in claim 1, further comprising computing means for producing an output signal when the optical density sensed by the sensor means is below a predetermined value.

5. An apparatus as in claim 1, further comprising a differential amplifier having one input connected to an output of the sensor means and another input connected to receive a reference voltage corresponding to a reference optical density.

6. An apparatus as in claim 5, in which an inverting input of the differential amplifier is connected to the output of the sensor means and a non-inverting input of the differential amplifier is connected to receive the reference voltage.

7. An apparatus as in claim 5, in which a non-inverting input of the differential amplifier is connected to the output of the sensor means and an inverting input of the differential amplifier is connected to receive the reference voltage.

8. An apparatus as in claim 1, in which the transfer member comprises an endless belt.

9. An apparatus as in claim 1, in which the transfer member comprises an electrically biased roller.

10. An apparatus as in claim 1, in which the photoconductive member has a rotating photoconductive surface, the sensor means being disposed downstream of the transfer member in a direction of rotation of the photoconductive surface.

11. An apparatus as in claim 1, in which the computing means comprises first comparator means for comparing the output of the auxiliary sensor means with a reference voltage corresponding to a reference optical density and producing an output corresponding thereto; and second comparator means for comparing the output of the first comparator means with the output of the sensor means.

12. An apparatus as in claim 11, in which the first comparator means comprises a voltage comparator for producing a zero output when the optical density sensed by the auxiliary sensor means is below the reference optical density and a maximum output when the optical density sensed by the auxiliary sensor means is above the reference optical density.

13. An apparatus as in claim 12, in which the second comparator means comprises a differential amplifier for producing an output corresponding to a difference between the outputs of the first comparator means and the sensor means.

14. An electrophotographic apparatus having a platen for supporting an original document on an image area of the platen, a photoconductive member, imaging means for forming an electrostatic image of the original document on an image area of the photoconductive member, developing means for developing the electrostatic image to form a toner image, transfer means including a transfer member for supporting a copy sheet on an image area of the transfer member and moving the copy sheet into engagement with the photoconductive member for transferring the toner image to the copy sheet, characterized by comprising:

mark means of predetermined optical density provided on a non-image area of the platen, the imaging means forming an electrostatic image of the mark means on a non-image area of the photoconductive member, the developing means developing the electrostatic image of the mark means to form a toner image thereof, the transfer means transferring the toner image of the mark means onto a non-image area of the transfer member; and sensor means for sensing an optical density of the toner image of the mark means on the transfer member;

the mark means comprising first and second marks of first and second different optical densities, the sensor means comprising first and second sensors for sensing optical densities of first and second toner images on the transfer member corresponding to the first and second marks respectively, the apparatus further comprising control means for controlling at least one of the imaging means, the developing means and the transfer means in accordance with a predetermined function of the sensed optical densities of the first and second toner images on the transfer member in combination.

15. An apparatus as in claim 14, in which the control means comprises comparator means for producing outputs indicating differences between output voltages of the first and second sensors and first and second reference voltages corresponding to first and second reference optical densities respectively.

* * * * *